US005448971A

United States Patent [19]

Blundell et al.

[11] Patent Number: 5,448,971

[45] Date of Patent: Sep. 12, 1995

[54] INTERNAL COMBUSTION ENGINE AND AN IMPROVED ROTARY INLET VALVE FOR USE THEREWITH

[75] Inventors: David W. Blundell, Attleborough; Neil D. Wilson, Norwich; James W. G. Turner, Hardingstone, all of United Kingdom

[73] Assignee: Group Lotus Limited, Norfolk, United Kingdom

[21] Appl. No.: 320,598

[22] Filed: Oct. 11, 1994

Related U.S. Application Data

[63] Continuation of Ser. No. 960,413, Feb. 11, 1993, abandoned.

[30] Foreign Application Priority Data

Jun. 20, 1990 [GB] United Kingdom ..... 9013788

[51] Int. Cl.[6] ..... F02B 75/02

[52] U.S. Cl. ..... 123/65 VB; 123/76; 123/190.12

[58] Field of Search ..... 123/296, 65 VB, 76, 123/190.12, 190.2, 432, 65 WA

[56] References Cited

U.S. PATENT DOCUMENTS

| | | | |
|---|---|---|---|
| 985,618 | 2/1911 | Miller . | |
| 1,189,625 | 7/1916 | Romberger | 123/190.2 |
| 1,347,978 | 7/1920 | Wehr . | |
| 1,530,390 | 3/1925 | Micklewood | 123/65 UB |
| 1,573,022 | 2/1926 | Wehr . | |
| 1,578,581 | 3/1926 | Casna | 123/190.2 |
| 1,887,997 | 11/1932 | Cross . | |
| 1,917,816 | 7/1933 | Spears | 123/190.2 |

(List continued on next page.)

FOREIGN PATENT DOCUMENTS

| | | |
|---|---|---|
| 0194503 | 9/1986 | European Pat. Off. . |
| 0271130A1 | 6/1988 | European Pat. Off. . |
| 2263375 | 10/1975 | France . |
| 1141490 | 12/1962 | Germany . |
| 61-16256(A) | 6/1986 | Japan . |
| 100761 | 7/1916 | United Kingdom . |
| 530934 | 12/1940 | United Kingdom . |
| 864453 | 4/1961 | United Kingdom . |
| 1496281 | 12/1977 | United Kingdom . |
| 1496282 | 12/1977 | United Kingdom . |
| 1496283 | 12/1977 | United Kingdom . |
| 1496284 | 12/1977 | United Kingdom . |

OTHER PUBLICATIONS

*Rotary Valves for Small Four-Cycle IC Engines,* Peter W. Gabelish, Albany R. Vial and Philip E. Irving, G.V. Technology PTY, Ltd.

*Primary Examiner*—Willis R. Wolfe
*Assistant Examiner*—Erick Salis
*Attorney, Agent, or Firm*—Fulwider Patton Lee & Utecht

[57] ABSTRACT

The internal combustion engine includes a working cylinder, a compressed air supply, an injector for supplying a gas and fuel mixture, an exhaust valve and an inlet valve. The inlet valve delivers both gas under pressure and gas and fuel mixture to the working cylinder, commencing delivery of the gas under pressure at an earlier stage in the engine cycle to the commencement of delivery of gas and fuel mixture. The inlet valve delivers gas under pressure to the cylinder at least for a part of the time that the exhaust port is open so as to drive combusted gases out of the working cylinder. The internal combustion engine also includes a rotary valve having a first member of a cylindrical external configuration, a sleeve surrounding the first member, and a mechanism for rotating the sleeve relative to the first member. The first member comprises a plurality of fluid passages and a plurality of apertures allowing communication of each of the passages with the exterior of the first member. The sleeve has at least one aperture which aligns with the apertures of the first member on rotation of the sleeve for a certain portion of the engine cycle. The rotary valve is positioned adjacent the cylinder such that a passage of the first member communicates with the cylinder when the associated aperture in the first member is aligned with the aperture in the sleeve.

25 Claims, 4 Drawing Sheets

U.S. PATENT DOCUMENTS

| | | | |
|---|---|---|---|
| 1,924,697 | 8/1933 | Shoemaker | 123/65 UB |
| 1,997,133 | 4/1935 | Cross . | |
| 2,017,196 | 10/1935 | Anglada et al. | 123/190.12 |
| 2,048,134 | 7/1936 | Montalto . | |
| 2,158,386 | 5/1939 | Sykes . | |
| 2,853,980 | 9/1958 | Zimmerman . | |
| 3,046,960 | 7/1962 | Dolza | 123/76 |
| 3,871,340 | 3/1975 | Zimmerman . | |
| 3,990,423 | 11/1976 | Cross et al. . | |
| 4,016,840 | 4/1977 | Lockshaw . | |
| 4,206,727 | 6/1980 | Siegien | 123/65 UB |
| 4,217,866 | 8/1980 | Nakajima | 123/76 |
| 4,546,743 | 10/1985 | Eickmann | 123/190.2 |
| 4,562,796 | 1/1986 | Eickmann | 123/65 UB |
| 4,597,321 | 7/1986 | Gabelish et al. . | |
| 4,809,649 | 3/1989 | Brinkman . | |
| 4,840,147 | 6/1989 | Tanahashi et al. | 123/432 |
| 4,864,979 | 9/1989 | Eickmann | 123/65 UB |
| 4,917,073 | 4/1990 | Duret | 123/65 UB |
| 4,926,809 | 5/1990 | Allen | 123/190.2 |
| 4,998,513 | 3/1991 | Gagnon | 123/76 |
| 5,005,537 | 4/1991 | Maissant | 123/65 UB |
| 5,205,251 | 4/1993 | Conklin | 123/190.2 |

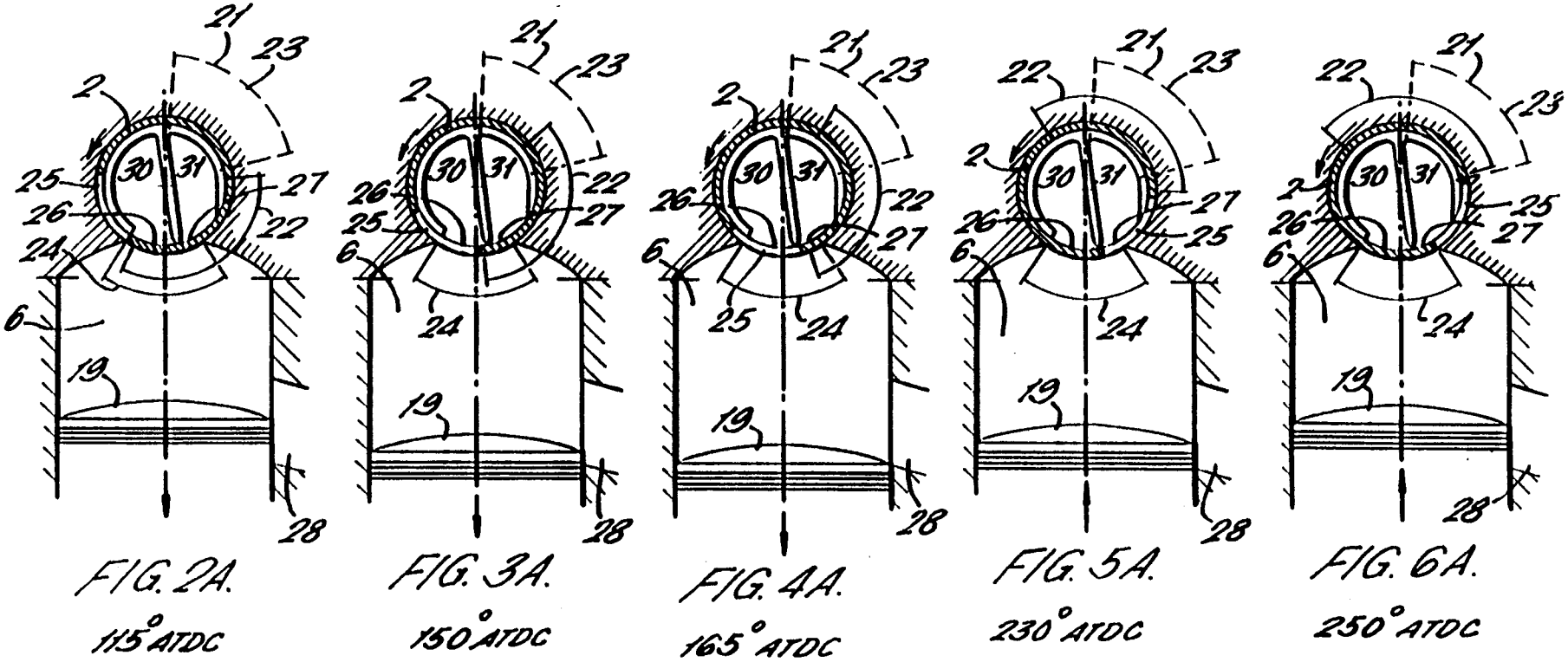
FIG. 2A. 115° ATDC
FIG. 3A. 150° ATDC
FIG. 4A. 165° ATDC
FIG. 5A. 230° ATDC
FIG. 6A. 250° ATDC

250° ATDC

215° ATDC

145° ATDC

130° ATDC

115° ATDC

INTERNAL COMBUSTION ENGINE AND AN IMPROVED ROTARY INLET VALVE FOR USE THEREWITH

This application is a continuation of application Ser No. 07,960,413, filed Feb. 11, 1993, now abandoned.

The invention relates to internal combustion engines and also to a rotary valve for use in internal combustion engines.

The invention can be used by many different types of engine (4 stroke, 2 stroke, rotary, etc.) although the specific description contained herein shall refer to 2-stroke engines only.

Conventional 2-stroke engines are "Crankcase scavenged". The fuel/air charge is induced into the crankcase as the piston rises up the cylinder, due to a pressure differential between that in the crankcase and atmospheric pressure. As the piston stars to descend, the inlet passage is closed by the piston and/or a reed valve and the trapped fuel/air mixture is compressed. Towards the bottom of its stroke, the piston opens the transfer ports and the compressed charge is transferred from the crankcase to the cylinder, scavenging exhausted gases from the last cycle out through the exhaust port to atmosphere before commencement of the compression stroke and subsequent combustion.

The main disadvantage of the method of charging described is that fuel/air mixture is used to scavenge the cylinder of exhaust gases and part of the fuel/air mixture is lost uncombusted through the exhaust port to atmosphere, increasing exhaust emissions, increasing fuel consumption and reducing potential power.

Further disadvantages are that the lubrication of the cylinder walls and the crankshaft and piston bearing relies on a "total loss" lubrication system, that is the lubricating oil is burnt with the fuel/air charge and expelled through the exhaust pore to atmosphere. This again increases exhaust emissions, contaminates any potential exhaust catalytic converters and requires periodic checks to ensure that sufficient oil is available in its respective tank. In addition, the piston is unable to dissipate its heat from the crown via an oil "Squirt Jet", as is the case in most contemporary wet sump engines. Consequently the piston/cylinder bore clearance must be greater than that in the said "wet slump" engine to ensure sufficient clearances when the cylinder bore is cold (winter morning cold start) and the piston hot. The increased piston/cylinder bore clearance results in a noisy engine and potentially higher compression and expansion losses. The piston crown temperature is limited in a conventional two-stroke dry sump engine since no cooling is available.

A preferred embodiment of the present invention comprises a rotary valve. Known rotary valves comprise primarily two fundamental types, the "Aspin" type, in which the valve axis is parallel to the cylinder axis and the valve rotates uncovering inlet and, subsequently, exhaust ports in phase with the piston. The other concept is the "Cross" type in which the valve axis is perpendicular to the cylinder axis and the valve itself transmits both the inlet charge and the exhaust gas through its own body.

A rotary valve according to the prior art is described in EP 0112 069. The rotary valve described is adapted to control the flow of fuel to and exhaust gases from a cylinder of an internal combustion engine. EP 0112069 describes a split cylindrical rotary valve comprising two chambers, each of which has a port allowing communication of the chamber with a cylinder of the engine for a part of the engine cycle. The cylindrical rotary valve is rotated relative to the engine block and cylinder head in a timed manner with reference to the motion of the piston in the cylinder. Radial and lateral seals separate the cylindrical split valve from the cylinder head but remains stationary with respect thereto.

The present invention provides both a new internal combustion engine and a new rotary valve for an internal combustion engine.

The present invention provides an internal combustion engine having at least one working cylinder comprising: means for supplying gas under pressure, means for supplying a fuel and gas mixture, exhaust valve means which operate in timed relationship to the engine cycle to allow gases to flow out of the working cylinder for a portion of the engine cycle, and inlet valve means which operates in timed relationship to the engine cycle and which connects the cylinder to the means for supplying gas under pressure at a first point of the engine cycle and which connects the cylinder to the means for supplying fuel and gas mixture at a second later point in the engine cycle, wherein the inlet valve means operates to connect the means for supplying gas under pressure to the cylinder for at least a part of the period during which the exhaust valve means allows gases to flow out of the cylinder such that the gas under pressure supplied to the cylinder drives combusted gases from the working cylinder.

The present invention thus provides an internal combustion engine in which a supply of air is used to assist the scavenging of combusted gases from the cylinder. This is beneficial to emissions and fuel economy.

Preferably the inlet valve means supplies both the gas under pressure and the fuel and gas mixture to the cylinder via a single port in the cylinder. By supplying both gas under pressure and fuel and gas mixture via one inlet port the number of ports in the engine is kept to two, avoiding the need for additional ports which decrease engine efficiency.

Preferably the valve means simultaneously supplies to the cylinder for a portion of the cycle of the engine both gas under pressure and fuel and gas mixture to the cylinder.

The successive introduction of pressurised air and then both pressurised air and gas and fuel mixture is beneficial to charge stratification and therefore assists combustion.

Preferably the valve means comprise a rotary valve which is connected to both the supply of gas under pressure and the supply of fuel and gas mixture.

By using a rotary valve both the pressurised air and the fuel and gas mixture can be supplied through one port in the cylinder. Therefore the transfer ports of traditional two-stroke engines are no longer necessary. This has the further advantage that a wet sump crankcase lubrication system as used in 4-stroke engines can be employed since the lubricating oil need not be burnt with the fuel and gas charge as has been normal with two-stroke engines. Obviously, engine emissions are beneficially altered by using a supply of fuel and gas mixture uncontaminated by lubricating oil.

The invention is suited to an internal combustion engine which operates by a 2-stroke cycle and wherein the supply of gas under pressure is connected to the cylinder during a downstroke of a piston moving within the cylinder whilst an exhaust port opening to atmosphere is open to the cylinder such that the combusted gases are scavenged from the cylinder. Preferably the gas under pressure and the fuel and gas mixture are supplied to the cylinder by a rotary valve, which valve is situated in the cylinder head.

The present invention also provides an internal combustion engine having: at least one working cylinder, an inlet port in the cylinder and inlet valve means connected to the inlet port comprising; a first member of a cylindrical external configuration and having a plurality of fluid passages therein and a plurality of apertures allowing communication of each of the passages with the exterior of the first member, a sleeve surrounding the first member and having at least one aperture and means for rotating the sleeve relative to the first member about a common axis, wherein the aperture of the sleeve aligns with one or more of the apertures of the first members during a desired range of relative rotation to allow communication of a passage in the first member with the working cylinder via the inlet port, the sleeve sealing the passage from the working cylinder when the said apertures are not in alignment.

The present invention provides a novel valve assembly having a plurality of passages which can each be used to deliver a gas or liquid or a mixture of both to a cylinder for a certain period in the engine cycle.

Preferably scavenge gas is delivered to the cylinder through a first passage in the first member when the aperture in the first member associated with first passage aligns with an aperture in the sleeve and fuel and gas mixture is delivered to the cylinder through a second passage in the first member when the apertures in the first member associated with the second passage aligns with an aperture in the sleeve.

The invention provides a rotary valve which can deliver both pure gas and fuel and gas mixture separately through one cylinder port. Thus one engine port can be used to provide both pure air for scavenging purposes and fuel and gas mixture for both the final scavenging necessary and also for combustion.

In a preferred embodiment the internal combustion engine of the invention further comprises measuring means to measure engine speed and means to rotate the first member about the common axis in accordance with engine speed, thereby altering the timing of communication between the working cylinder and the passages in the first member of the valve means and/or altering the range of relative rotation between the sleeve and the first member during which the aperture in the sleeve aligns with each of apertures of the first member.

The valve of the invention can be used to alter with engine speed the relative amounts of fluid and/or gas and/or mixture delivered from the supply passages to the cylinder.

The internal combustion engine could also comprise measuring means to measure engine temperature and means to rotate the first member about the common axis in accordance with engine temperature and/or means to measure load on the engine and means to rotate the first member about the common axis in accordance with engine load.

Preferably the firs member and the sleeve of the inlet valve means are located in a cavity defined in the cylinder head or cylinder block of the engine and an annular cavity is defined between the exterior of the sleeve and the cylinder block along a portion of the length of the sleeve, the sleeve and the first member having apertures which align for a range of rotational position of the sleeve to allow communication between a passage in the first member and the annular cavity, and the said annular cavity communicates with means for supplying fuel and gas mixture, whereby the fuel and gas mixture is mixed in the annular cavity by turbulence caused by the rotation of the sleeve.

The turbulent mixing of the fuel and gas mixture aids combustion by ensuring efficient mixing.

Preferably the means for supplying fuel and gas mixture comprises a gas compressor and a fuel injector injecting fuel into the gas and preferably the fuel injector is positioned within the cylinder head or cylinder block such that it sprays fuel on to the sleeve of the inlet valve means.

The sleeve will be hot in operation of the engine since it is exposed to the combustion of the cylinder. The hot surface of the sleeve aids evaporation of the fuel.

In one embodiment the gas and fuel mixture supplied is an air and fuel mixture. This is conventional.

In an alternative embodiment the gas and fuel mixture supplied to the cylinder is a mixture of fuel, air and combusted gases exhausted from the working cylinder. The use of hot exhaust gas as a portion of the total mixture improves atomisation and vaporisation of the fuel and can also be beneficial in reducing engine emissions.

Preferred embodiments of the present invention will now be described with reference to the accompanying drawings, in which;

FIGS. 2A to 6A are simplified diagrammatic cross-sections of a piston and cylinder arrangement at different stages during a cycle.

FIGS. 2B to 6B are simplified diagrammatic cross-sections of a piston and cylinder arrangement according to the invention showing the same sequence as FIGS. 2A to 6A but with the arrangement adjusted to account for a change in engine speed and/or load and/or temperature.

Figure 1:
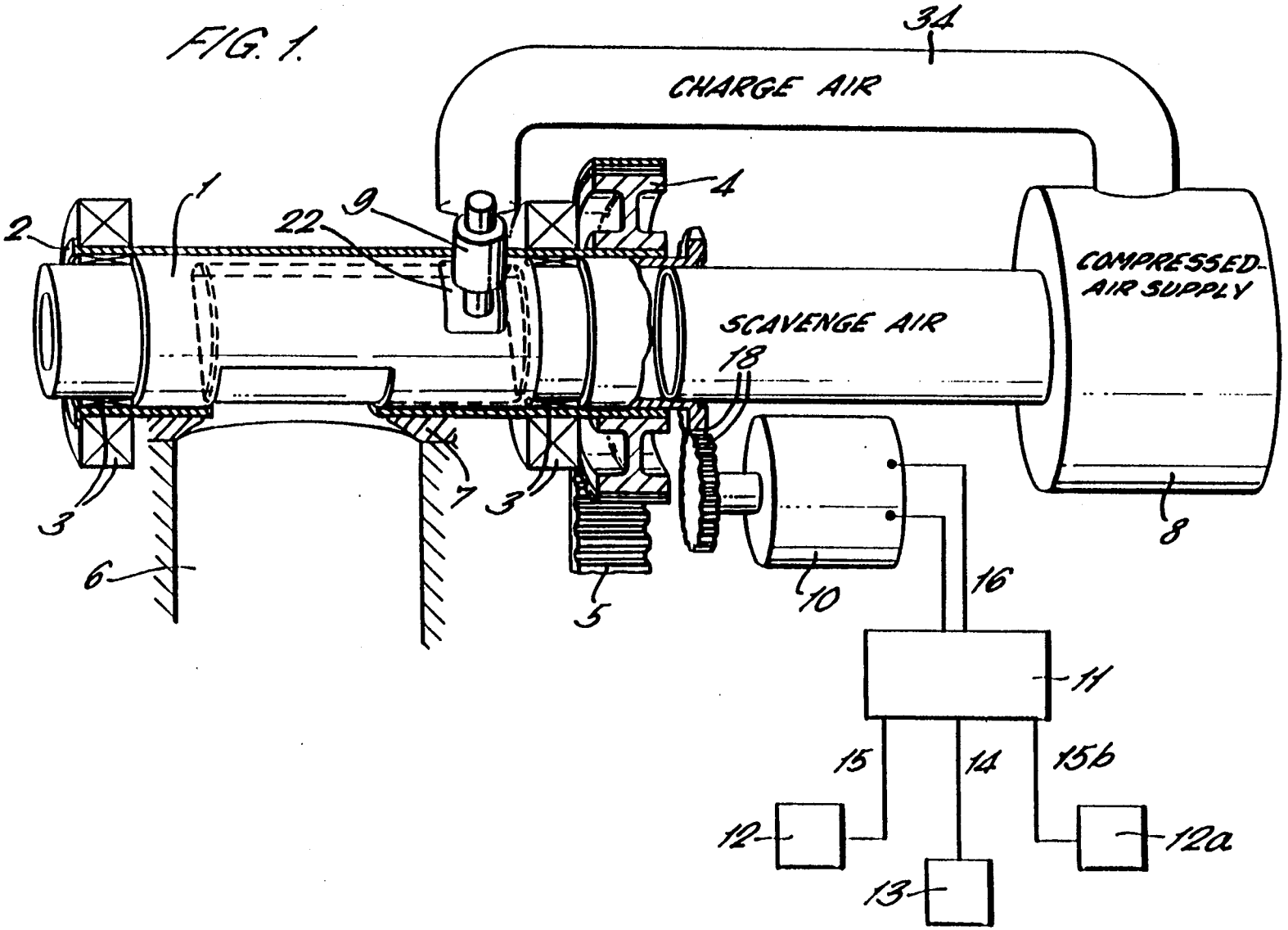
FIG. 1 is a schematic representation of one embodiment of the invention.
Figure 6B:
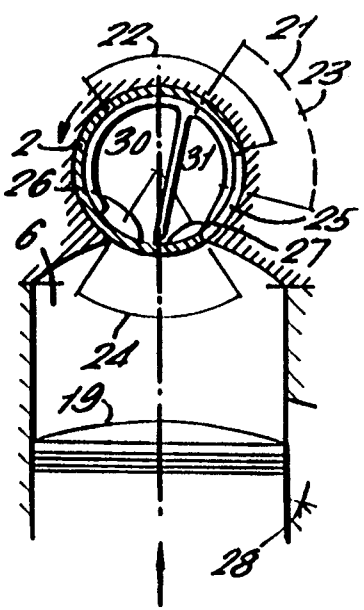

FIG. 1 shows a first member 1, a sleeve 2, bearings 3, a pulley 4, a belt 5, driven from the engine output crankshaft (not shown), a cylinder 6, a cylinder head 7, a compressor 8, a fuel injector 9, a servo-motor 10, a control unit 11, a speed sensor 12, a pressure sensor 12*a* and temperature sensor 13.

The temperature sensor 13 is disposed in the engine cooling system to measure the coolant temperature therein. The sensor sends a signal via a line 14 to the control unit 11.

The engine speed sensor 12 measures the rotational speed of the engine in which the arrangement is present. The engine speed sensor 12 sends a signal to the control unit 11 via line 15.

The pressure sensor 12*a* measures inlet manifold pressure and sends a signal corresponding thereto via the line 15*b* to the control unit 11. The sensor is an option considered by the applicant.

The control unit 11 compares and combines the signals it receives in accordance with pre-programmed instructions. The control unit 11 sends an instructions signal to the servo-motor 10 via lines 16. The signal instructs the servo motor to rotate the first member 1 to a required angle with regard to an arbitrary fixed reference via gears 18.

In the preferred embodiment the first member 1 is cylindrical and is partitioned into two passages 30 and 31, to segregate fuel/air or "charge" mixture from the pressurised "scavenge" air. In a first embodiment the first member has two apertures 26 and 27 adjacent the inlet port of the combustion chamber. The first member also has an aperture 23 which allows (when uncovered) pressurised air to be delivered into passage 31.

Pressurised "scavenge" air is fed axially along the first member through one passage 30 thereof from a compressor. The compressor could be a supercharger or turbocharger or compression of the air could take place in the crankcase. The pressurised air is contained within passage 30 of the first member until the aperture 25 of the sleeve 2 coincides with the aperture 26 of the first member 1 and the inlet port 24 combustion chamber, typically 113° after top dead centre. Upon reaching this condition fresh "scavenge" air, ie. without the addition of fuel, is transferred from the compressed gas source, via the first member 1, to the cylinder 6 where it commences the cylinder scavenging cycle, forcing burnt gasses to atmosphere through the exhaust port 28.

After the sleeve 2 rotates approximately a further 30° an aperture 22 of the sleeve 2 and an aperture 23 leading to the second passage 31 of the first member 1 coincide and compressed air is delivered into the second passage 31 from an external source compressed the passage 34 and compression air supply 8. The pressurised air is introduced into the passage 31 of the first member and fuel is mixed therewith, such fuel being sprayed by the fuel injector 9 into the airstream passing thereby.

At approximately 165° ATDC, the aperture 25 in the sleeve coincides with the aperture 27 in the first member and the fuel/air mixture is fed into the cylinder. As the sleeve continues to rotate, the flow of "scavenge" air is gradually reduced by reduction of the area of the aperture 26 open to the cylinder 6, until approx 230° ATDC when the sleeve 2 closes the "scavenge" air aperture 26, leaving only the "charge" air aperture 27 open. It is the intention of this invention that the positioning of the "charge" air aperture 27 should provide a degree of charge "Stratification" ie. a relatively rich mixture predominantly about the ignition source.

At approximately 250° ATDC the "charge" air aperture 27 in the first member is completely closed by the sleeve 2. When the piston closes the exhaust port 28 the compression stroke begins.

It should be noted that the positions of rotation of the engine referred to above and in the drawings in terms of degrees after top dead centre are purely illustrative and the timing of the opening of apertures 26 and 27 to the cylinder 6 can vary substantially. Indeed the preferred embodiment of the invention allows the timing to be varied, as described below.

By rotation of the first member 1, the angle/area of the fuel/air aperture 27 that is open to the combustion chamber can be reduced/increased. It is therefore proposed that this invention incorporates a servo motor or similar driven by a control unit comprising electronic circuiting which compares and combines signals it receives from speed, temperature and pressure sensors, in accordance with pre-programmed instructions. This "variable valve timing" would enable the fuel requirements to be optimised for different running conditions, ie. engine speed/load/temperature.

Figure 2B:
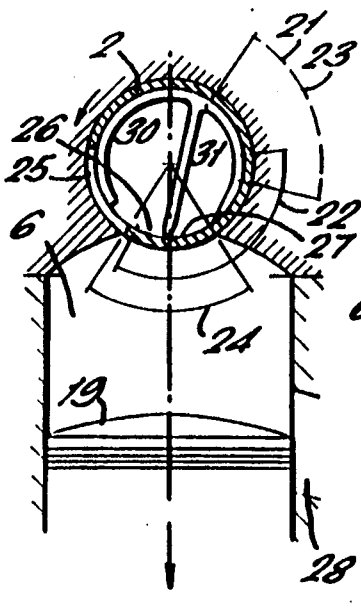

Referring to FIGS. 2A to 6A the method of operation of the invention during an engine cycle can be seen. FIG. 2A shows a piston 19, the cylinder 6, an inlet aperture 21 in the cylinder head, a sleeve inlet aperture 22, a first member inlet aperture 23, a cylinder head "transfer" aperture 24, a rotatable member transfer aperture 25, a first member scavenge aperture 26, a first member charge transfer aperture 27 and an exhaust aperture 28. The figure is simplified for clarity and does not show the servo-motor 10, the control unit 11, the electrical sensors 12 and 13, the gears 18 or the pulley. The figures show a sequence for low engine speed and/or low engine load operation.

FIG. 2A shows the piston 19 at a point in the exhaust cycle where the cylinder pressure has decayed to a pressure equal to or just below that of the "charge" pressure, at approx 115° after top dead centre (ATDC). The sleeve is being rotated anti-clockwise by the belt 5. In FIG. 2A the leading edge of the transfer aperture 25 in the sleeve is flush with the leading edges of both the scavenge transfer aperture 26 in the first member and the cylinder head transfer aperture 24. The first member inlet aperture 23 is covered by the sleeve 2. The scavenge passage 30 of the delivery member contains pressurised air delivered from the compressed air supply 8. The fuel/air passage 31 is sealed from communication with the exterior of the first member 1 by the sleeve 2.

Figure 3B:
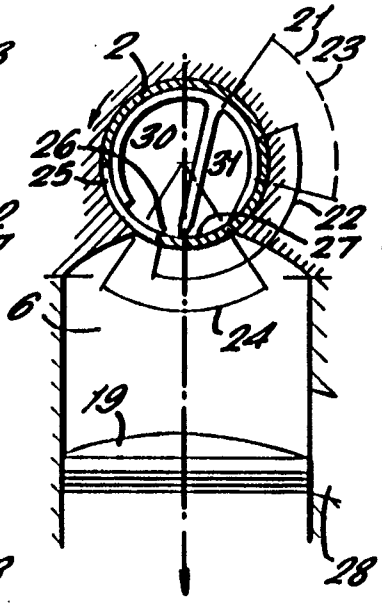

FIG. 3A shows the piston 19 at a point in the scavenge cycle where the exhaust aperture 28 is still open and the sleeve 2 has rotated such that the leading edge has uncovered the aperture 26 in the first member to a point just prior to uncovering of the charge transfer aperture 27. The inlet aperture 23 is just uncovered by the sleeve inlet aperture 22 and pressurised air flows through the passage 34 to the passage 31 being mixed with fuel delivered by fuel injector 9. Typically this point occurs for low engine speed and/or load at a point approx 145° ATDC. The passage 30 is in communication with the cylinder 6 and delivers air under pressure thereto to force out residual combusted gases. The fuel/air passage 31 is in communication via inlet aperture 23 with a supply of air under pressure to which fuel has been added by the fuel injectors.

Figure 4B:
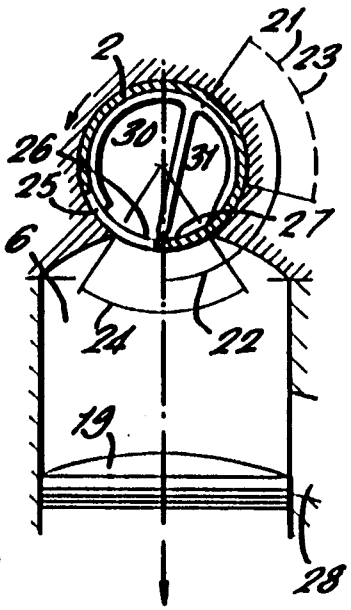

FIG. 4A shows the piston 19 at a point approximately midway through the scavenge cycle and at the start of the charge induction cycle. The leading edge of the sleeve "transfer" aperture 25 is flush with the edge of the charge transfer aperture 27. The inlet aperture 23 connecting passage 31 to the supply of fuel/air mixture is uncovered by the sleeve member inlet aperture 22 and the fuel injector 9 has started its injection cycle. Typically this point occurs at approx 165° ATDC.

Figure 5B:
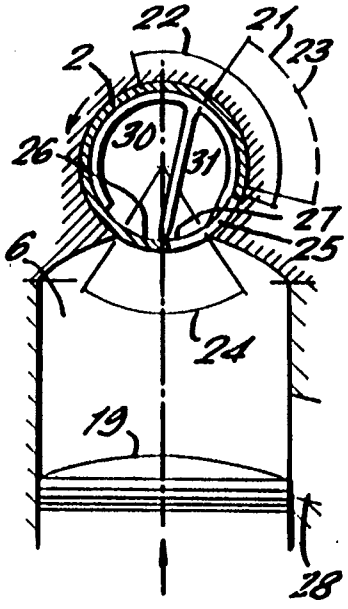

FIG. 5A shows the piston 19 at a point towards the end of the charge transfer cycle. The trailing edge of the sleeve transfer aperture 25 is flush with the edge of the first member charge transfer aperture 27. The first member inlet aperture 23 is fully open. Typically this point occurs at approx 230° ATDC. The "scavenge" passage 30 is sealed and therefore ceases to deliver scavenging air under pressure to the cylinder 6. The fuel/air passage 31 is in communication with the cylinder 6 and delivers fuel/air mixture thereto.

FIG. 6A shows the sleeve 2 rotated to seal both of the passages 30 and 31 from the cylinder 6. The passages remain sealed from the cylinder 6 until the sleeve again reaches the position of FIG. 2A, during which time the fuel/air mixture of cylinder 6 is compressed and then combusted.

The FIGS. 2A to 6A show operation of a rotary valve according to the invention in an engine operating at low loads and/or low speeds. The angle through which the sleeve rotates between opening and closing the said aperture 26 is greater than the angle through which the sleeve rotates between opening and closing the aperture 27. Therefore a greater portion of each engine cycle is devoted to scavenging by compressed air than to the scavenging by fuel/air mixture and the delivery of such mixture for combustion. Since the engine speed and/or load are low sufficient fuel can be delivered to the cylinder even though the fuel/air mixture is delivered to the cylinder for only a small portion of each engine cycle.

FIGS. 2B to 6B shown the same cycle of events as FIGS. 2A to 6A. However, the first member position does not correspond to that in FIGS. 2A to 6A. The control system has acted to take account of high engine speed and/or load and has caused the servo motor to rotate the first member in a clockwise direction such that the leading edge of the sleeve transfer aperture 25 uncovers the first member charge transfer aperture 27 earlier in the cycle than in FIGS. 2A to 6A. It is expected that this 'charge' advancement could be of the order of 20°. The angle through which the sleeve 2 rotates between opening and closing of the scavenge air aperture 26 is less than the angle it rotates between opening and closing aperture 27. Therefore fuel/air mixture is delivered to the cylinder 6 for a greater portion of each engine cycle with the first member i rotated as in FIGS. 2B to 6B then as rotated in FIGS. 2A to 2B.

At higher engine speeds and/or loads the time available for delivering sufficient fuel/air mixture to the cylinder 6 is less than at low engine speeds and/or loads and therefore it is necessary to devote a greater portion of each cycle at high speeds and/or loads to the delivery of fuel/air mixture. The control device 11 will map the signals of load and speed it receives from the sensors 12 and 12*a* on to a table of optimum rotational positions of the first member 1 stored in the memory.

The control device 11 will also control the rotation of the first member in accordance with engine temperature, as sensed by sensor 13. The control device will map the engine temperature signal onto the mapping table along with signals indicative of engine speed and load to determine by optimum rotation of the first member 1. Generally speaking the first member 1 will be rotated in accordance with engine temperature such that a greater portion of each engine cycle is devoted to the delivery of fuel/air mixture at lower engine temperatures than at high engine temperatures. Therefore a higher fuel/air ratio will be present in the cylinder 6 at low temperatures, reducing the energy required to propagate a flame.

Figure 7:
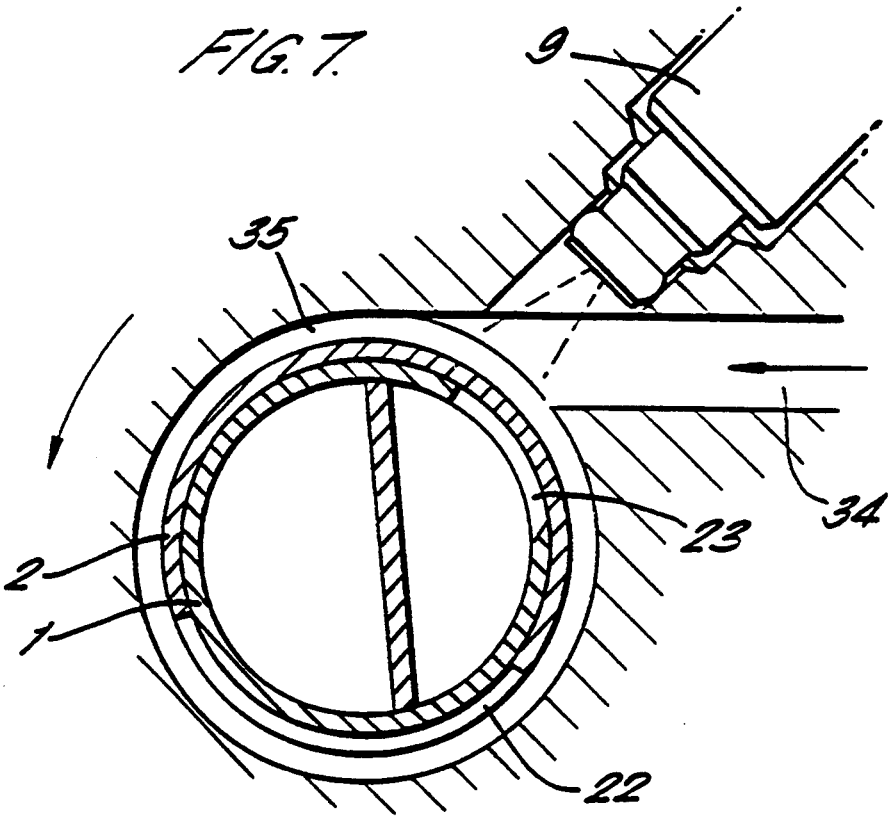
FIG. 7 shows a transverse cross-sectional view of a rotary valve of a second embodiment of the invention.
Figure 8:
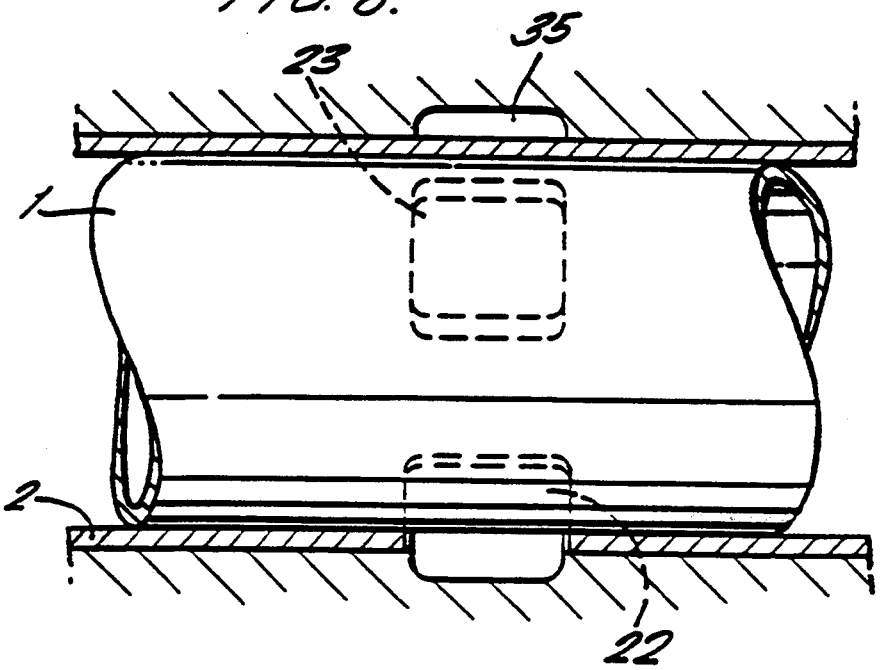
FIG. 8 shows and axial cross-sectional view of the rotary valve of FIG. 7.

A second embodiment of a two-stroke engine according to the invention is shown in FIGS. 7 and 8. The second embodiment is identical in most respects to the embodiment already described and the components will be referenced accordingly.

The additional feature of the second embodiment is the annular cavity 35. The compressed air is continuously introduced into the annular cavity 35. Fuel is injected into the airflow by injector 9. The sleeve 2 is rotating anti-clockwise as seen in FIG. 7 and therefore the flow of air from passage 34 is tangential to and in the same sense as the rotation of the sleeve. The rotating sleeve causes turbulence on the fuel/air mixture in the annular cavity 35 which improves mixing. Furthermore heat from combustion is transmitted along the sleeve 2 from the section where the sleeve 2 seals and opens the working cylinder 6 of the engine. The hot surface of the sleeve 2 aids evaporation of the fuel sprayed on to it by injector 9.

When the aperture 22 in the sleeve 2 aligns with the aperture 23 in the member 1 then the pressurised turbulent fuel/air mixture flows from the annular cavity 35 to the passage 31 to be delivered to the cylinder 6.

Whilst in the embodiments described above pressurised air is mixed with fuel before introduction into the cylinder the applicant envisages that exhaust gases could be mixed with fuel as well as air. The passage 34 would in such circumstances be connected via suitable pumping or impeller means to a portion of the exhaust passage combusted gases to supplement or replace a supply of air. The combusted gases will be hot and aid evaporation of the fuel. Furthermore emissions to atmosphere such as $NO_x$ emissions will be reduced by reusing the exhaust gas.

The benefits of the present invention are a potential reduction in exhaust emissions and fuel consumption due primarily to the "fresh air" scavenging but also in part by the partial "charge stratification". In addition, by introducing the scavenge air in the same direction as the mass flow of the exhaust gas ie. "uniflow scavenging", the energy required to scavenge the cylinder is potentially less than that required for a "loop" scavenged or "cross" scavenged cylinder and the time taken for the scavenging cycle is also potentially reduced. A further advantage of "uniflow scavenging" is due to the increasing of the "short circuiting" path, i.e. the distance of the charge entry point from the exhaust port. This increase will be reflected in improved idle and low speed/low load stability due to improved trapping and scavenging efficiencies.

The invention further provides a rotary valve for an internal combustion engine which may be easily controlled to vary the timing of the opening and closing of the valve apertures of a cylinder in accordance with varying engine parameters.

The specific embodiment described above makes reference to use of the invention in a two-stroke engine. Quite clearly the rotary valve of the invention could be used in any engine and need not necessarily be restricted to carrying fuel/air mixture and air under pressure to the cylinder. The rotary valve herein described could also be used to convey fuel/air mixture to and exhaust gases from a cylinder as mentioned in the prior art document EP 0112069.

We claim:

1. An internal combustion engine having: at least one working cylinder, an inlet port in the cylinder and inlet valve means connected to the inlet port comprising:

a first member of cylindrical external configuration and having a plurality of fluid passages therein and having a plurality of apertures allowing communication of each of the fluid passages with the exterior of the first member, a sleeve surrounding the first member and having at least one aperture and means for rotating the sleeve relative to the first member about a common axis, wherein the at least one aperture of the sleeve aligns with a first aperture of the first member during a first desired range of relative rotations commencing at a first point in an engine cycle to allow communication of a first fluid passage in the first member with the working cylinder via the inlet port, the at least one aperture aligns with a second aperture of the first member during a second desired range of relative rotations commencing at second later point in the engine cycle to allow communication of a second fluid passage in the first member with the working cylinder via the inlet port, the sleeve sealing the fluid passage from the working cylinder when the said apertures are not in alignment and means is provided to rotate the first member about the common axis thereby altering both the first and second ranges of relative rotations during which the aperture in the sleeve aligns with the apertures in the first member.

2. An internal combustion engine as claimed in claim 1 wherein gas and air mixture is delivered to the cylinder through the second fluid passage in the first member when the associated aperture in the first member aligns with the second aperture in the sleeve.

3. An internal combustion engine as claimed in claim 1 wherein gas under pressure is delivered to the cylinder through the first fluid passage in the first member when the associated aperture in the first member aligns with an aperture in the sleeve.

4. An internal combustion engine as claimed in claim 1 further comprising measuring means to measure engine speed wherein the means to rotate the first member about the common axis rotates the first member in accordance with engine speed.

5. An internal combustion engine as claimed in claim 1 further comprising measuring means to measure engine temperature wherein the means to rotate the first member about the common axis rotates the first member in accordance with engine temperature.

6. An internal combustion engine as combined as claimed in claim 1 further comprising means to measure load on the engine wherein the means to rotate the first member about the common axis rotates the first member in accordance with engine load.

7. An internal combustion engine as claimed in claim 1 wherein the first member and the sleeve of the inlet valve means are located in a cavity defined in a cylinder head of the engine and an annular cavity is defined between the exterior of the sleeve and the cylinder head along a portion of the length of the sleeve, the sleeve and the first member having apertures which align for a range of rotational positions of the sleeve to allow communication between a passage in the first member and the annular cavity, and in which the annular cavity communicates with means for supplying fuel and gas mixture under pressure, whereby the fuel and gas mixture is mixed in the annular cavity by turbulence caused by the rotation of the sleeve.

8. An internal combustion engine as claimed in claim 7 wherein the means for supplying fuel and gas mixture under pressure comprises a gas compressor and a fuel injector injecting fuel into the gas.

9. An internal combustion engine as claimed in claim 8 wherein the fuel injector is positioned within the cylinder head such that it sprays fuel on to the sleeve of the inlet valve means.

10. An internal combustion engine as claimed in claim 1 which operates with a two-stroke cycle.

11. An internal combustion engine as claimed in claim 1 wherein an air and fuel mixture is supplied to the working cylinder via a fluid passage in the first member.

12. An internal combustion engine as claimed in claim 1 wherein a mixture of fuel, air and combusted gases exhausted from the working cylinder is supplied to the working cylinder via a fluid passage in the first member.

13. An internal combustion engine as claimed in claim 1 comprising:

means for supplying gas under pressure, means for supplying a fuel and gas mixture, exhaust valve means which operates in timed relationship to the engine cycle to allow gases to flow out of the working cylinder for a portion of the engine cycle, wherein the inlet valve means operates in timed relationship to the engine cycle and connects the working cylinder with the means for supplying as under pressure at the first point of the engine cycle and connects the working cylinder with the means for supplying fuel and gas mixture at the second later point in the engine cycle, the inlet valve means operates to connect the means for supplying gas under pressure with the working cylinder for at lest a part of a period during which the exhaust valve means allows gases to flow out of the working cylinder and the gas under pressure is supplied to the cylinder through a port in the cylinder head to drive combusted gases from the working cylinder, and the engine operates by a two-stroke cycle and the exhaust valve means comprises an exhaust port in the cylindrical wall of the working cylinder spaced axially along the working cylinder from the inlet valve means, which exhaust port is opened and closed by a piston reciprocating in the cylinder.

14. An internal combustion engine as claimed in claim 13 wherein the inlet valve means comprises a rotary valve located in the cylinder head of the engine via which the fuel and gas mixture is supplied to the working cylinder.

15. An internal combustion engine as claimed in claim 14 wherein the area of the rotary valve through which fuel and gas mixture is delivered to the working cylinder is variable and control means are provided to vary the area with engine speed.

16. An internal combustion engine as claimed in claim 13 wherein the inlet valve means supplies both the gas under pressure and the fuel and gas mixture to the cylinder via a single port in the working cylinder.

17. An internal combustion engine as claimed in claim 13 wherein the inlet valve means simultaneously supplies to the working cylinder for a portion of the cycle of the engine both gas under pressure and fuel and gas mixture.

18. An internal combustion engine as claimed in claim 1 wherein the means to rotate the first member about the common axis rotates the first member to alter the timing of communication between the working cylinder and the fluid passages in the first member of the inlet valve means.

19. An internal combustion engine as claimed in claim 1 wherein the means to rotate the first member about the common axis rotates the first member to alter the range of relative rotations between the sleeve and the first member during which the aperture in the sleeve allows communication of each of the fluid passages in the first member with the working cylinder.

20. An internal combustion engine as claimed in claim 1 comprising:

means for supplying gas under pressure, means for supplying a fuel and gas mixture, and exhaust valve means which operates in timed relationship to the engine cycle to allow gases to flow out of the working cylinder for a portion of the engine cycle, wherein the inlet valve means operates in timed relationship to the engine cycle and connects the working cylinder with the means for supplying gas under pressure at a first point of the engine cycle and connects the working cylinder with the means for supplying fuel and gas mixture at a second later point in the engine cycle, and the inlet valve means operates to connect the means for supplying gas under pressure with the working cylinder for at least a part of the period during which the exhaust valve means allows gases to flow out of the cylinder such that the gas under pressure supplied to the cylinder drives combusted gases from the working cylinder.

21. An internal combustion engine as claimed in claim 20 wherein the inlet valve means supplies both the gas under pressure and the fuel and gas mixture to the working cylinder via a single port in the cylinder.

22. An internal combustion engine as claimed in claim 20 wherein the inlet valve means simultaneously supplies to the working cylinder for a portion of the cycle of the engine both gas under pressure and fuel and gas mixture.

23. An internal combustion engine as claimed in claim 20 which operates by a 2-stroke cycle and wherein the supply of gas under pressure is connected to the working cylinder during a downstroke of a piston moving within the working cylinder whilst an exhaust port opening to the atmosphere is open to the working cylinder such that combusted gases are scavenged from the working cylinder.

24. An internal combustion engine as claimed in claim 1 wherein the first member and the sleeve of the inlet valve means are located in a cavity defined in a cylinder block of the engine and an annular cavity is defined between the exterior of the sleeve and the cylinder block along a portion of the length of the sleeve, the sleeve and the first member having apertures which align for a range of rotational positions of the sleeve to allow communication between a passage in the first member and the annular cavity, and in which the annular cavity communicates with means for supplying fuel and gas mixture under pressure, whereby the fuel and gas mixture is mixed in the annular cavity by turbulence caused by the rotation of the sleeve.

25. An internal combustion engine as claimed in claim 24 wherein a fuel injector is positioned within the cylinder block such that it sprays fuel on to the sleeve of the inlet valve means.

* * * * *